United States Patent [19]

Miller et al.

[11] Patent Number: 4,798,264

[45] Date of Patent: Jan. 17, 1989

[54] KNEELING AID

[76] Inventors: Jack V. Miller; Ruth Ellen Miller, both of 700 N. Auburn Ave., Sierra Madre, Calif. 91024

[21] Appl. No.: 138,651

[22] Filed: Dec. 28, 1987

[51] Int. Cl.[4] ..... A47C 9/00; A47C 13/00

[52] U.S. Cl. ..... 182/230; 182/228

[58] Field of Search ..... 182/230, 106, 15, 228

[56] References Cited

U.S. PATENT DOCUMENTS

| | | | |
|---|---|---|---|
| 830,103 | 9/1906 | Rundell | 182/230 |
| 1,408,253 | 2/1922 | Blank | 182/230 |
| 2,069,476 | 2/1937 | Keil | 182/230 |
| 2,093,888 | 9/1937 | Holtje | 182/230 |
| 2,448,427 | 8/1948 | Gordon | 182/230 |
| 3,826,336 | 7/1974 | Cramer | 182/15 |
| 4,418,792 | 12/1983 | Cerone | 182/106 |
| 4,763,756 | 8/1988 | Horan | 182/230 |

*Primary Examiner*—Reinaldo P. Machado

[57] ABSTRACT

A kneeling aid to facilitate kneeling has planar, rectangular, platform, the upper surface provided with recessed storage compartments bounded by upstanding ribs, and a pair of three-sided recesses bounded by upstanding ribs conforming to the size and shape of a pair of resilient concave and knee-conforming pads, each three-sided recess having its fourth side open along one side of the platform. A recessed socket is provided at each corner of each end of the rectangle and an inverted U-shaped strut is installed at each end of the platform, each strut having a pair of depending legs engaged into the respective recessed sockets at each end of the rectangle.

A preferred embodiment has the rectangular platform molded as a hollow plastic part including an upstanding beam extending between the recessed sockets on one long side of the rectangle, has the inverted U-shaped struts made of metal tubing, and has a tubular resilient handle disposed about the base portions connecting the legs of the strut.

9 Claims, 3 Drawing Sheets

KNEELING AID

BACKGROUND OF THE INVENTION

This invention relates to kneeling aids that are commonly in use for providing assistance for a person to assume a kneeling position, and to cushion the knees when kneeling on a hard surface, such as a floor or the ground. These products are sometimes called "kneelers" and are used for gardening, cleaning floors and in construction trades, such as flooring or concrete finishing, requiring work at floor level.

Such devices are presently made by welding a pair of upstanding steel tubes, having horizontal handles at their upper ends, to a horizontal steel plate having upstanding ribs along both edges to provide stiffness. The steel plate is covered with a flat layer of resilient padding having marginal comfort for the user's knees. This is biomechanically incorrect, as the human knee is extremely sensitive to discomfort due to pressure on the ligamentum patellae; the part of the knee in contact with the floor when kneeling. That is the very tender spot the physician strikes with the mallet to check your reflexes.

The upstanding ribs along the edges of the platform also represent a safety hazard. If the user mis-judges slightly, he or she may be injured by dropping to a kneeling position with the knees right on top of the sharp metal edge. One dominant manufacturing cost in presently known kneelers is in the covering of the entire surface of the steel platform with that layer of padding that still is uncomfortable, since, no matter where the user kneels on the pad, the load is always concentrated directly on the ligamentum patellae.

Available kneeling aids are also quite heavy and bulky to ship and store. Some models are available with the upstanding tubes segmented with slip joints to reduce shipping and storage bulk, but that adds to the cost and weight. Another problem in using the heavy steel kneeling aids is that they require handling by both handles in order to avoid barking the ankles on the metal plate edges, and that metal plate will often damage the surfaces of floors or uncured concrete.

SUMMARY OF THE INVENTION

A primary purpose of the present invention is to provide a kneeling aid that is lightweight, easy and inexpensive to manufacture and compact for shipping and storage.

It is a further purpose of the present invention to provide a kneeling aid that provides knee cushions that are biomechanically designed to provide comfort for the user.

It is another purpose of the present invention to provide a kneeling aid that is devoid of sharp edges or corners that may be damaging to floor surface and may injure the user.

The achievement of the foregoing purposes of the invention is accomplished in a preferred embodiment including a generally planar, rectangular platform on which the upper surface is provided with recessed storage compartments bounded by upstanding ribs, and a pair of three-sided recesses bounded by upstanding ribs conforming to the size and shape of a pair of resilient concave and knee-conforming pads, each three-sided recess having its fourth side open along one side of the platform. This arrangement is a clear improvement in both cost and function over a flat pad. There is no need for any cushioning material where the knees don't touch the platform, and the comfort of the cushions is greatly enhanced by distributing the load around, instead of directly on, the ligamentum patellae.

A recessed socket is provided at each corner of each end of the rectangle and an inverted U-shaped strut is installed at each end of the platform, each strut having a pair of depending legs engaged into the respective recessed sockets at each end of the rectangle. This arrangement provides two structural columns for each handle, making the downward loads almost purely compressive. This is a great improvement over the present single column designs, where a load on the horizontal handle applies a severe bending load on the column in compression. The result is a safer structure that can be made of lighter material, such as aluminum tubing.

A preferred embodiment of the present invention provides the horizontal platform made of a hollow plastic material, such as blow-molded or rotational molded polyethylene or polypropylene. These materials are very light and inexpensive, and the double walls of the hollow structure provide a very rigid body. The recesses for the knee cushions are attached to the top surface only, and have a natural shock absorbing function when the top surface flexes. The inverted U-shaped struts, preferrable made of drawn aluminum tubing, are plugged into the recessed sockets in the platform, providing secure handles for the user.

The bottom surface of the platform is smooth and planar, with no sharp edges or corners that could injure the user or scratch a floor surface. The bottoms of the recessed sockets in the top surface are bonded during molding to the bottom surface. providing rigidity for the U-shaped struts. The present invention as described herein effectively overcomes the deficiencies of presently known kneelers, and represents a significant improvement in performance, comfort, safety and cost over prior art devices.

DETAILED DESCRIPTION OF THE DRAWINGS

Figure 1:
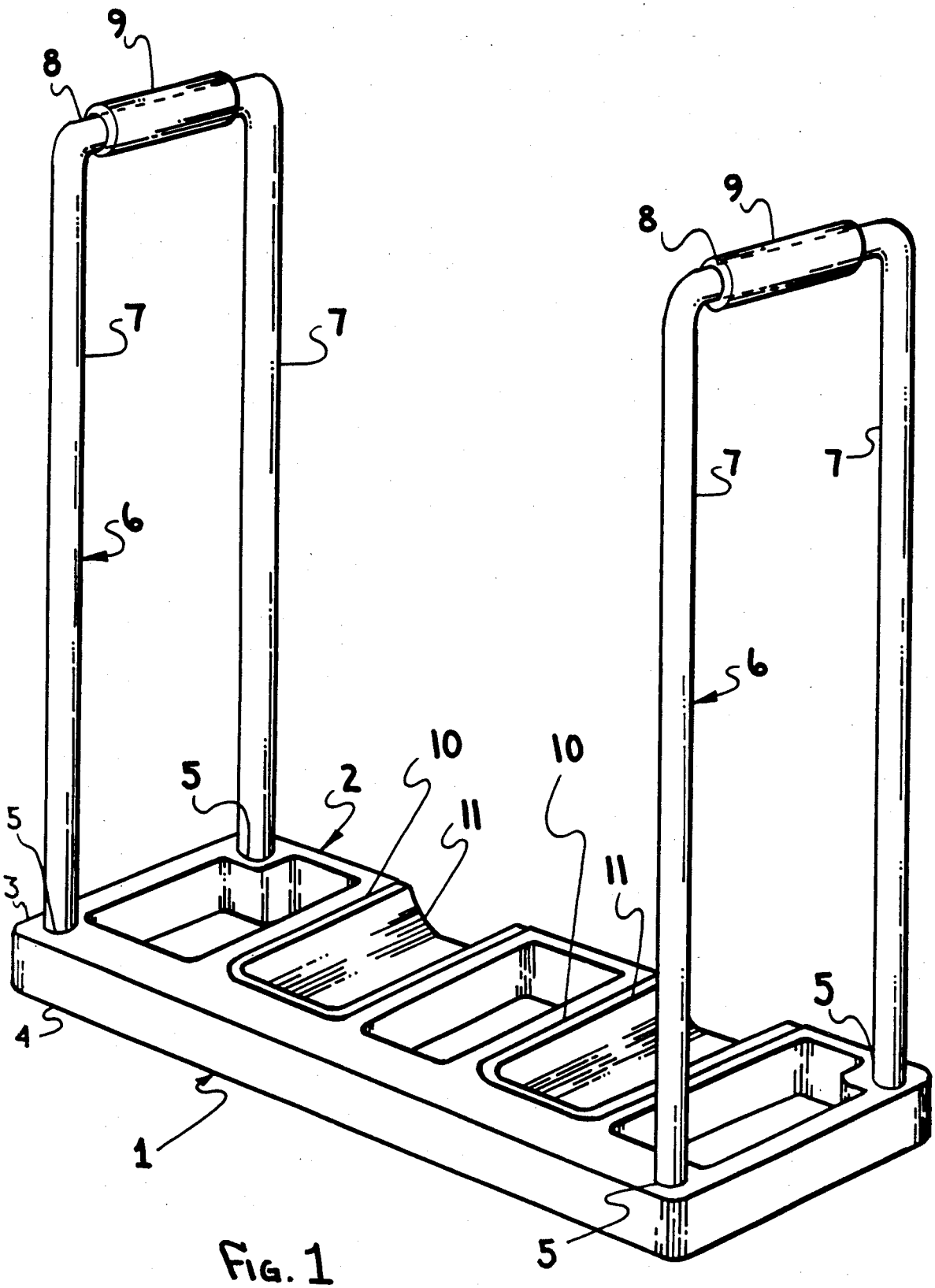
FIG. 1 shows a perspective view of a kneeling aid according to the present invention.

In FIG. 1 kneeling aid 1 is shown having a generally planar platform 2 having an upper surface 3 and a lower surface 4. Upper surface 3 is provided with a recessed socket 5 at each corner of each end of platform 2. An inverted U-shaped strut 6 is at each end of platform 2, each strut 6 having a pair of depending legs 7 joined together by a base 8 and inserted into respective recessed sockets 5 of platform 2. Each base 8 of each strut 6 has a resilient tubular handgrip 9, such as foam rubber tubing disposing about it. A pair of recesses 10 in upper platform surface 3 holds a pair of resilient knee cushions 11, whereby a user may grip the handgrips 9 and lower his weight to kneel with his knees on cushions 11.

Figure 2:
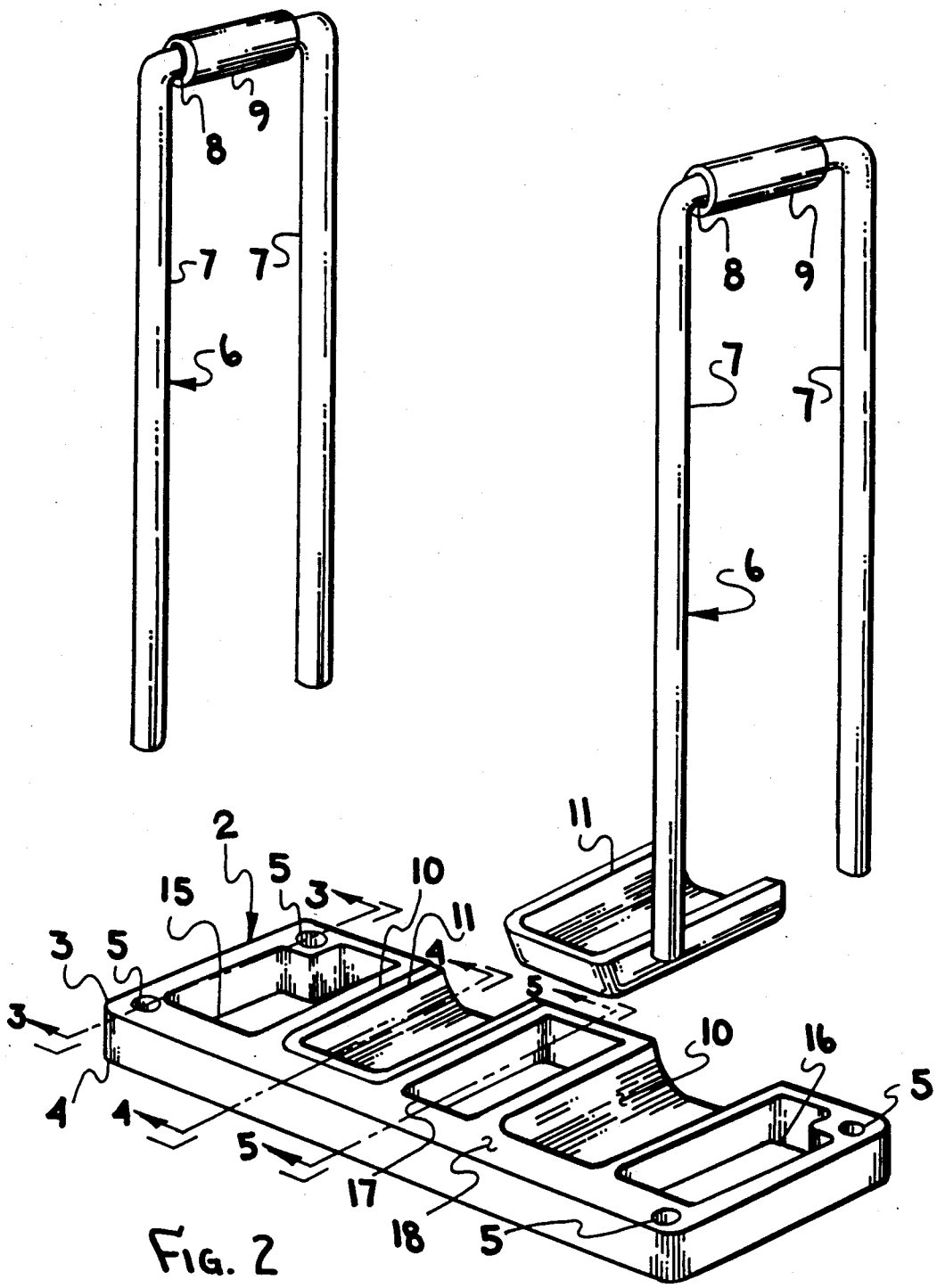
FIG. 2 is an exploded perspective view of the kneeling aid of FIG. 1.

In the exploded view of FIG. 2, platform 2 is shown having a first storage recess 15 at one end of platform 2, a second storage recess 16 at the other end, and a third storage recess 17 centrally positioned between the knee cushions 11. The two recesses 10 have only three sides, the fourth side remaining open so there is no upstanding rib for the user's knee to strike. Each cushion 11 is bonded into the respective recess 10, using any suitable adhesive, such as hot-melt glue or sheet adhesive. An upstanding rib 18 extends between the two recessed sockets at either end of platform 2 in order to provide bending stiffness for platform 2 when struts 6 are installed.

Figure 3:
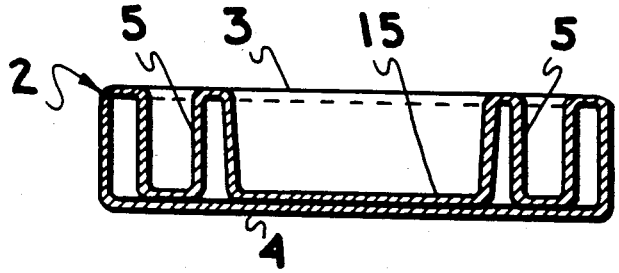
FIG. 3 is a transverse cross-sectional view of a portion of FIG. 2, taken along line 3—3.

In FIG. 3 a cross section of platform 2 is shown having the recessed sockets 5 extending from the upper surface 3 to be integral with the lower surface 4. Recess 15 is shown able to store tools or materials.

Figure 4:
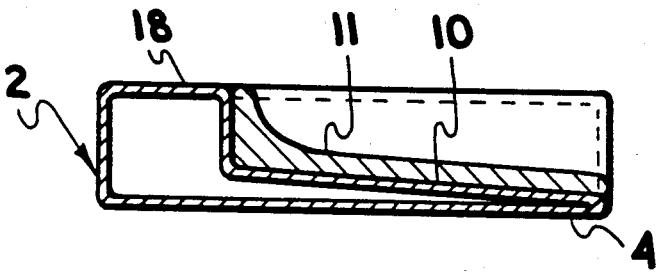
FIG. 4 is a transverse cross-sectional view of a portion of FIG. 2, taken along line 4—4.

In FIG. 4 a cross section of platform 2 is shown having knee cushion 11 bonded into recess 10. Recess 10 is spaced a distance "S" from lower surface 4, so that the user's knees are further cushioned from the ground or floor. The upstanding rib 18 has a hollow cross section to provide great stiffness for platform 2.

Figure 5:
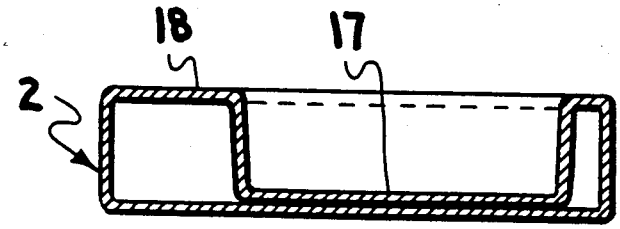
FIG. 5 is a transverse cross-sectional view of a portion of FIG. 2, taken along line 5—5.

In FIG. 5 a cross section of platform 2 is shown having recess 15 for the storage of tools or materials, and having upstanding rib 18 providing stiffness for platform 2.

The kneeling aid as shown and described is extremely lightweight and inexpensive to manufacture. For shipping the struts 6 are removed and laid flat in a box along with platform 2 for assembly by a purchaser. The user only needs to insert the two struts 6 into the sockets 5 of platform 2 to assemble the kneeling aid. The knee cushions 11 are contoured to properly support the knees without applying pressure on the user's ligamentum patellae. The entire bottom surface 4 of platform 2 is smooth and flat, with no sharp edges or corners. The present invention as shown represents a significant improvement over presently known kneeling aids.

We claim:

1. A kneeling aid to facilitate kneeling including:

a generally planar and generally rectangular, elongated horizontal platform having a lower surface and an upper surface, the upper surface being provided with a recessed socket at each corner of each end of the platform, said recessed sockets in the upper surface terminating at, and bonded to the lower surface of the platform;

an inverted U-shaped strut at each end of the platform and having a pair of depending legs engaged into the respective recessed sockets at each end of the rectangle; and a cushion means on the upper surface of the platform.

2. A kneeling aid according to claim 1 in which the cushion means is a pair of resilient concave pads contoured to generally match the shape of a human knee in the kneeling position.

3. A kneeling aid according to claim 1 in which each inverted U-shaped strut is a metal tube that is slidably engaged into the recessed sockets of the platform.

4. A kneeling aid according to claim 1 in which each inverted U-shaped strut is provided with a resilient tubular handle disposed about the base portion of the U connecting the legs of the strut.

5. A kneeling aid according to claim 1 in which the upper surface of the platform is provided with with an upstanding beam extending between the recessed sockets on one long side of the rectangle.

6. A kneeling aid according to claim 1 in which the upper surface of the platform is provided with one or more recessed storage compartments bounded by upstanding ribs.

7. A kneeling aid according to claim 1 in which the upper surface of the platform has a pair of three-sided recesses bounded by upstanding ribs conforming to the size and shape of a pair of resilient concave pads, said recesses each having its fourth side open along one side of the platform.

8. A kneeling aid according to claim 1 in which the platform is a molded plastic part.

9. A kneeling aid according to claim 1 in which the platform is a hollow molded plastic part.

* * * * *